US009098985B2

(12) United States Patent
Hetterly

(10) Patent No.: US 9,098,985 B2
(45) Date of Patent: Aug. 4, 2015

(54) RESTAURANT SERVICE INDICATOR SYSTEM METHOD AND KIT

(71) Applicant: James Hetterly, Montverde, FL (US)

(72) Inventor: James Hetterly, Montverde, FL (US)

( * ) Notice: Subject to any disclaimer, the term of this patent is extended or adjusted under 35 U.S.C. 154(b) by 0 days.

(21) Appl. No.: 13/850,349

(22) Filed: Mar. 26, 2013

(65) Prior Publication Data

US 2014/0292500 A1 Oct. 2, 2014

(51) Int. Cl.
*G08B 7/06* (2006.01)

(52) U.S. Cl.
CPC ..... *G08B 7/068* (2013.01)

(58) Field of Classification Search
CPC ..... G08B 7/068
USPC ..... 340/286.01, 286.02, 286.06, 286.09, 340/539.11, 572.1, 4.61, 573.1, 6.1; 705/15, 21, 30; 455/466, 500; 709/206
See application file for complete search history.

(56) References Cited

U.S. PATENT DOCUMENTS

| | | | | |
|---|---|---|---|---|
| 5,845,263 | A * | 12/1998 | Camaisa et al. | 705/15 |
| 6,366,196 | B1 * | 4/2002 | Green et al. | 340/286.09 |
| 6,973,437 | B1 * | 12/2005 | Olewicz et al. | 705/15 |
| 2004/0143503 | A1 * | 7/2004 | Suthar | 705/15 |
| 2004/0158494 | A1 * | 8/2004 | Suthar | 705/15 |
| 2008/0228608 | A1 * | 9/2008 | Kurahashi et al. | 705/30 |
| 2008/0256192 | A1 * | 10/2008 | Pinard et al. | 709/206 |
| 2009/0027226 | A1 * | 1/2009 | Mannke, Jr. | 340/825.49 |
| 2011/0199215 | A1 * | 8/2011 | Biessman et al. | 340/573.1 |

* cited by examiner

*Primary Examiner* — Van Trieu
(74) *Attorney, Agent, or Firm* — Jason T. Daniel, Esq.; Daniel Law Offices, P.A.

(57) ABSTRACT

A restaurant service indicator system method and kit includes a table unit having a processor, memory, a request sent indicator and transmitter that are communicatively linked to server unit having a processor, memory, table status indicator and receiver; The invention also includes a method for receiving, transmitting and displaying service request messages utilizing at least one table unit and server unit; The invention also includes a kit comprising a plurality of table units communicatively linked to a single server unit, a charger and instructions.

9 Claims, 3 Drawing Sheets

RESTAURANT SERVICE INDICATOR SYSTEM METHOD AND KIT

TECHNICAL FIELD

The present invention relates generally to the field of restaurant equipment, and more particularly to a system for allowing restaurant patrons to communicate with their wait staff electronically.

BACKGROUND

The statements in this section merely provide background information related to the present disclosure and may not constitute prior art.

At restaurants, bars and café's around the world, it is common practice to assign a single member of the wait staff (i.e., restaurant server, waiter or waitress) to be responsible multiple tables at one time. In the course of their duties, the server will constantly be roaming all across the premises in order to take customer orders, prepare beverages, communicate with the kitchen staff, seat new patrons and, of course, deliver food to tables. In this regard, the server may not always be available when a particular table desires immediate attention.

Alternatively, sometimes the restaurant wait staff can be too attentive. Whether it results from inexperience on the part of the server, boredom, and/or an over attentive disposition, there are times when a patrons overall dining experience can be negatively impacted due to constant interruptions by their assigned server.

Accordingly, there remains a need for a restaurant service indicator system capable of allowing a patron to inform the wait staff when their presence is desired, and when they wish to be left alone.

SUMMARY OF THE INVENTION

The present invention is directed to a restaurant service indicator system method and kit. One embodiment of the present invention can include a table unit having a processor, memory, and transmitter for sending user service requests received by one or more input devices, and further including a visual indication that the request has been sent. The system also includes a server unit having a processor, memory, and a receiver for receiving the service request and a plurality of table status indicators providing a visual indication of the type of service request, and which of the table units sent the request.

Another embodiment of the present invention can include a method for receiving, transmitting and displaying service request messages utilizing at least one table unit and server unit.

Yet another embodiment of the present invention can include a kit comprising a plurality of table units communicatively linked to a single server unit, a charger and instructions.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
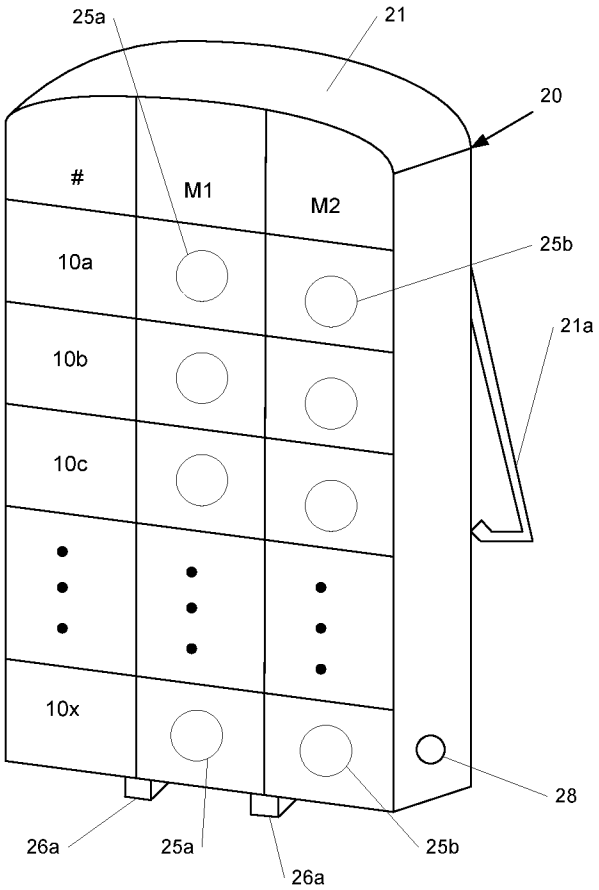
FIG. 1 is a perspective view of a restaurant service indicator system that is useful for understanding the inventive concepts disclosed herein.
Figure 1:
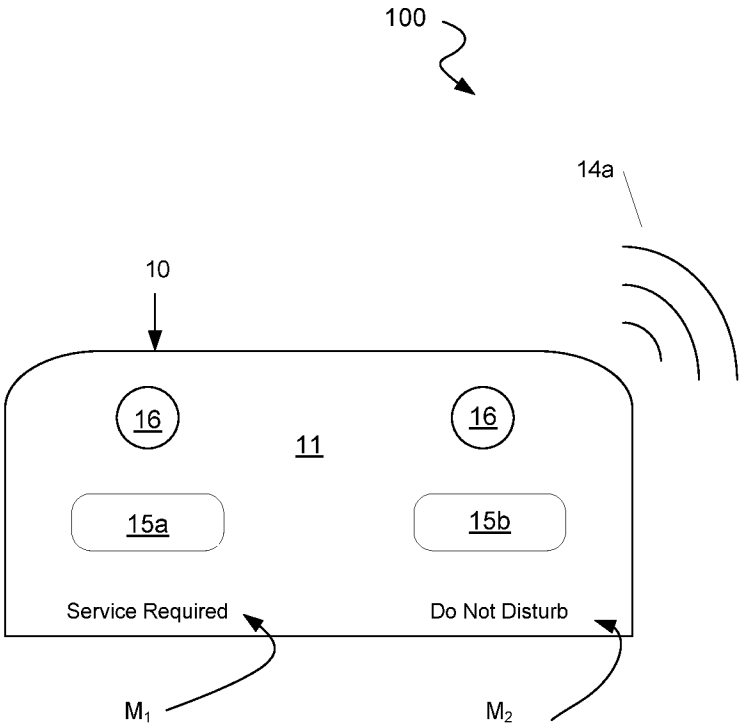

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Although described throughout this document as pertaining to restaurants and the like, the inventive concepts disclosed herein are not to be construed as limited to the food service industry, as any number of other uses and applications are contemplated.

Figure 2:
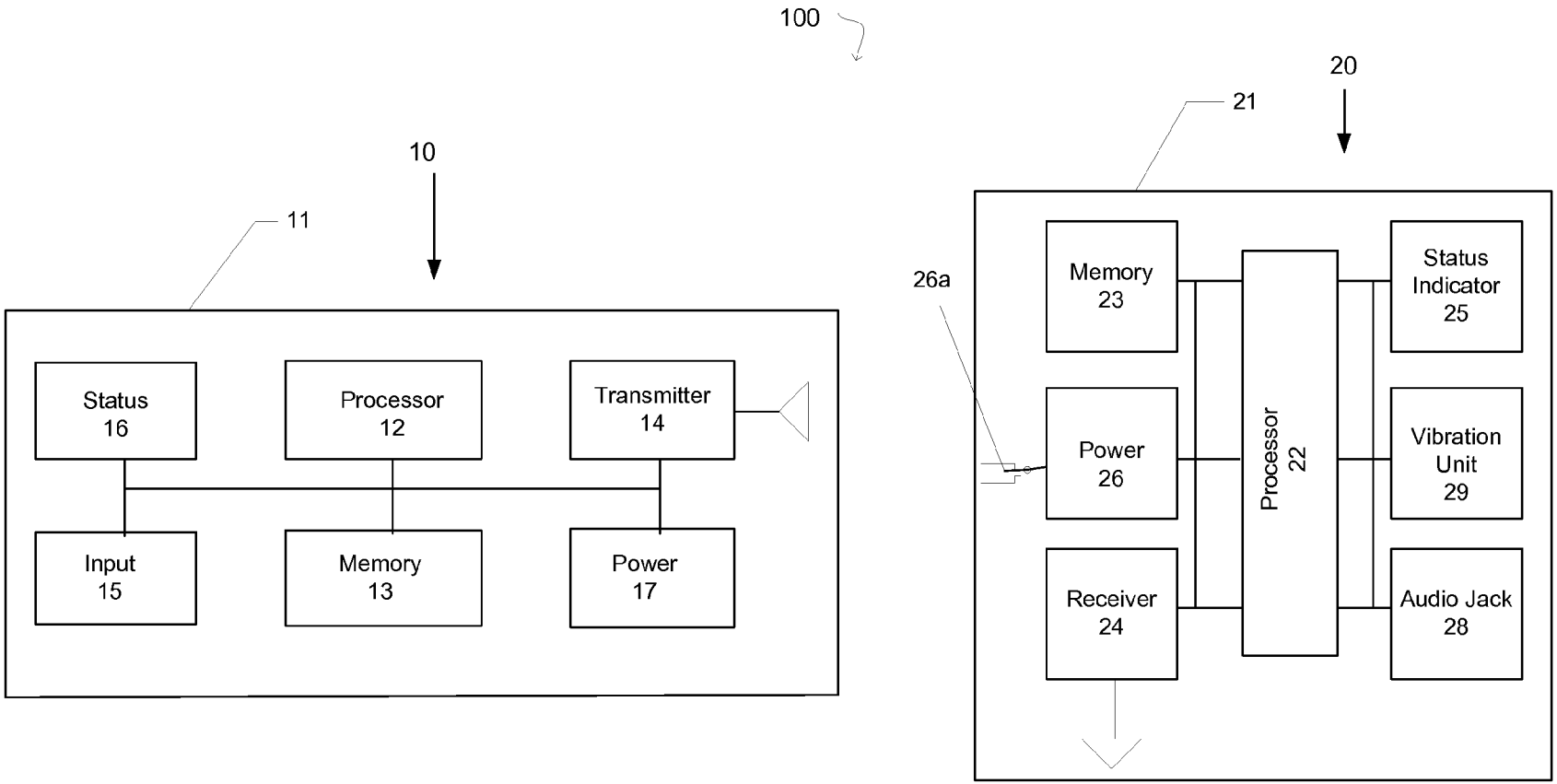
FIG. 2 is a schematic diagram of the restaurant service indicator system, according to one embodiment of the invention.

FIGS. 1 and 2 illustrate one embodiment of a restaurant service indicator system 100 that is useful for understanding the inventive concepts disclosed herein. As shown, the system can include one or more table units 10 and a server unit 20 that are capable of communicating with one another. In operation, the system 100 can allow a restaurant patron (i.e., user) to initiate electronic communication with a restaurant wait staff in order to indicate a service request.

In one embodiment, each table unit 10 can include an outer shell/body 11 for housing a processor 12 that is conventionally connected to an internal memory 13, a transmitter 14, one or more push buttons 15, one or more request sent indicators 16 and power source 17.

The body 11 can take any number of distinct shapes, and can be constructed from any number of known materials and methods. In one preferred embodiment, the table body 11 can be constructed from injection molded plastic having a plurality of internal connectors (not shown) for securely positioning each of the elements 12-17 in a secure manner. Of course, other known materials and manufacturing processes are also contemplated.

Although described above as a "table unit", this is not to be limiting in any manner. To this end, the device 10 can include any number of connectors and other common hardware suitable for mounting the device onto any number of different objects, depending on the intended use of the system.

The processor 12 can act to execute program code stored in the memory 13 in order to allow the device to perform the functionality described herein. Processors are extremely well known in the art, therefore no further description will be provided.

Memory 13 can act to store operating instructions in the form of program code for the processor 12 to execute. Although illustrated in FIG. 2 as a single component, memory 13 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 13 can also include one or more cache memories that provide temporary storage of at least some program code in order to reduce the number of times program code must be retrieved from the bulk storage device during execution. Each of these devices are well known in the art.

The transmitter 14 can act to transmit a signal from the table unit 10 to the server unit 20. In one preferred embodiment, the transmitter can include a variable radio wave transmitter having a unique radio frequency chip capable of transmitting a plurality of independent radio frequencies 14*a* containing a particular service request (i.e., a service request signal) that is stored in the memory 13, and associated with a particular push button 15. As will be described below, each of these signals can be received and interpreted by the server unit 20, to display a corresponding message.

Although described as using radio transmission, reception and frequencies, other communication mediums and their associated components are also contemplated. For example, infrared (IR), Bluetooth, RFID, microwave and other known communication mediums, along with their respective hardware components, can also be utilized without deviating from the scope and spirit of the inventive concepts disclosed herein.

A plurality of push buttons 15 can be disposed onto the device 10 in order to accept user inputs and independently initiate programming for instructing the processor 12 to communicate one or more signals to the server unit 20. In one preferred embodiment, the device can include two push buttons 15*a* and 15*b*, each representing a different service request. For example, button 15*a* can represent a first service request M1 indicating a "come now" message, and button 15*b* can represent a second service request M2 indicating a "do not disturb" message.

A request sent indicator 16 can be associated with each of the push buttons 15 of the device. Each request indicator can function to provide a visual notification to a user that confirms their service request has been transmitted to the wait staff. In one preferred embodiment, the device can include two request sent indicators 16*a* and 16*b*, comprising a green and red Light Emitting Diode (LED), respectively. Each of these indicators can be activated by the processor 12 upon receiving a signal from the respective push button.

Although described above as utilizing push buttons as the primary interface between a user and the device, this is for illustrative purposes only, as those of skill in the art will recognize that any number of different input devices ranging from toggle switches, to a keypad, for example, can also be utilized. Additionally, although illustrated as including only two buttons and indicators, other embodiments having more or fewer buttons are also contemplated. Each of these buttons being capable of transmitting a different signal to the server unit indicating a different service request.

In one preferred embodiment, the power source 17 of the device 10 can include one or more DC batteries capable of providing the necessary power requirements to each element of the table unit 10. To this end, the main body can further include an accessible cavity wherein batteries can be installed and replaced as needed. As described herein, the batteries can preferably include lithium ion type batteries, but other types of conventional batteries such as NiCad and/or rechargeable batteries are also contemplated. In an alternate embodiment (not shown) the power unit can include a common A/C electrical power transformer and cord capable of allowing the table unit 10 to be powered from a standard electrical outlet. Such a feature can be utilized, for example, in instances where the table unit 10 is incorporated into the design of the table itself.

The Server unit 20, in accordance with one embodiment, can include a main body 21 for housing a processor 22 that is conventionally connected to an internal memory 23, a receiver 24, a table status indicator 25, and a power source 26.

The body 21 can take any number of distinct shapes and can be constructed from any number of known materials and methods. In one preferred embodiment, body 21 can be constructed from injection molded plastic having a plurality of internal connectors (not shown) for securely positioning each of the elements 22-26 within the housing. Of course, other known materials and manufacturing processes are also contemplated.

Owing to the fact that the Server unit 20 is designed to be worn by a server during the performance of their duties, it is preferable that the device 20 be as small and lightweight as possible. As such, in one preferred embodiment, a spring clip 21*a* or other such attachment device can be disposed along the back side of the main body 21 in order to allow a server to clip the unit to their clothing. In this manner, the overall appearance of the device can resemble a beeper or pager. Of course, any number of other attachment means can also be utilized, such as a chain for wearing around a servers' neck, for example.

The processor 22, memory 23 and power source 26 can be substantially identical to the processor 12, memory 13 and power source 17 described above, respectively. Additionally, the server unit can further include charging prongs 26*a* for allowing the unit to interface with a charging station in order to keep the power source 26 charged at all times, when the power source 26 includes rechargeable batteries.

The receiver 24 can act to receive the transmitted service request signal 14*a* from the transmitter 14 of one or more table units 10. In one preferred embodiment, the receiver 24 can include a variable radio wave receiver having a unique radio frequency chip capable of receiving and translating a plurality of independent radio frequencies associated with a particular service request of a particular table unit 10. These received signals are ultimately sent to the processor 22 and/or the memory 23 of the server unit 20. Upon receipt of one or more of these signals, the processor can activate the status indicator light associated with the service request signal of the particular table unit that sent the request. This can be accomplished in accordance with known techniques, such as assigning different frequencies to each of the table units and/or including an identifier signal within each transmission, for example.

A plurality of status indicator lights 25 can be disposed on the server unit 20 in order to indicate a service request from one or more of the above described table units. The indicator lights preferably including multiple green LED's 25*a* and multiple red LED's 25*b*. To this end, each of the lights 25 can be displayed in a grid-like manner wherein one green light 25*a* and one red light 25*b* are associated with a single table unit 10*a*-10*x* of the system.

In operation, the system 100 can allow a patron to quickly and easily communicate a service request to their waiter in an electronic manner. The process can be initiated by a user selecting an appropriate button 15*a* or 15*b* from on the table unit 10. Upon depressing one of the buttons 15*a* and 15*b*, the processor 12 can instruct the transmitter 14 to send an appropriate signal 14*a* that includes a message corresponding to M1 or M2, respectively, while simultaneously activating the corresponding indicator 16 of the table unit.

The transmitted frequency can be received by the receiver 24 of the server unit 20 and decoded by the processor 22 in accordance with known transmission, reception and coding methodologies. Upon receipt of the signal, the processor 22 can determine which of the table units 10*a*-10*x* transmitted the request and whether the request indicates message M1 (come now) or message M2 (do not disturb), for example. Once this determination is made, the processor 22 can activate the appropriate indicator light 25*a* or 25*b* for the selected table unit.

Once a particular button 15 has been pressed, the indicator lights 16 and 25 associated with that button will preferably remain illuminated until instructed otherwise. As such, the lights 16 and 25 can be extinguished when a different button 15 on the same table unit 10 has been pressed, thereby activating a different light, or by repressing the same button 15 which will extinguish the associated lights.

In another embodiment, the server unit 20 can also include additional forms of notification units. For example, the device can also include an audio jack 28 and a vibration unit 29 suitable for providing non-visual notification to a user regarding a received service request.

The audio jack 28 can function to interface with a headphone and/or ear jack, for example, for sending an audible notification tone to the user upon receipt of a signal 14*a*. Likewise, the vibration unit can include any number of known devices suitable of creating a strong vibration of the main body 21 which can be easily felt by a server wearing the device. Each of these components and their associated hardware are extremely well known in the art, and can function to alert a server that they have received a service request, the specifics of which can be determined by looking at the indicator lights 25.

Figure 3:
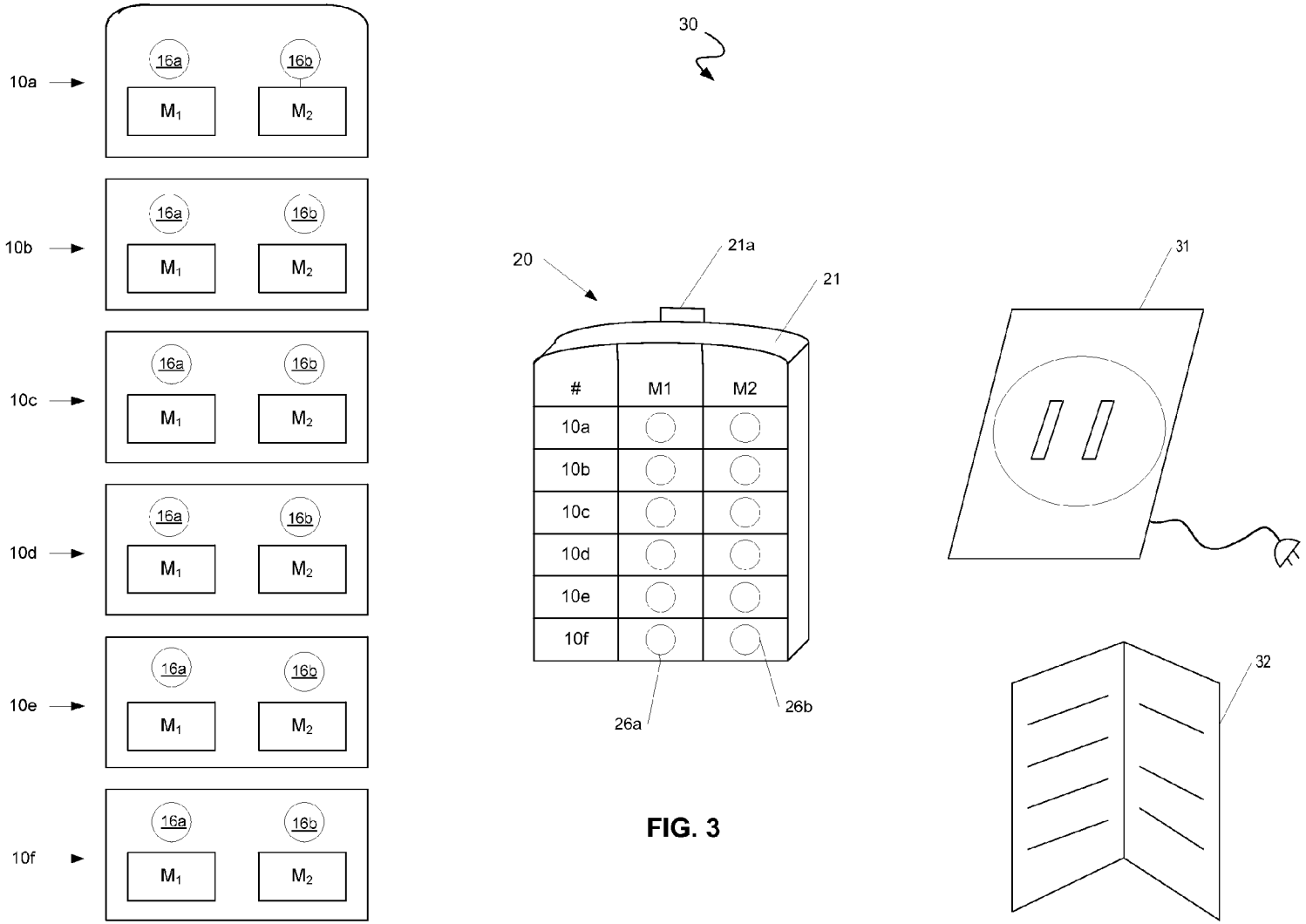
FIG. 3 is a perspective view of a restaurant service indicator system kit, in accordance with one embodiment of the invention.

As shown in FIG. 3, the restaurant service indicator system can be presented as a kit for use in virtually any industry. As shown, the kit 30 can include up to six table units 10*a*, 10*b*, 10*c*, 10*d*, 10*e* and 10*f*, a single server unit 20, a charging station 31 and an instruction manual 33. Each of the table units 10*a*-10*f* and the server unit 20 can be pre-programmed to communicate via the various transmitters and receiver discussed above, so as to operate "out of the box". As described herein, the user instructions can include a pamphlet, video, dvd or other such medium for advising a user on proper setup, operation and care for the kit. Additionally, the charging station can include any commercially available battery charger.

Accordingly, the above noted system provides a new and novel means of transmitting a service request message which can be quickly set up and inexpensively operated by a variety of service type industries.

As described herein, one or more elements of each of the table unit 10 and the server unit 20 can be secured together utilizing any number of known attachment means such as, for example, screws, glue, compression fittings and welds, among others. Moreover, although the above embodiments have been described as including separate individual components, the inventive concepts disclosed herein are not so limiting, as functional components can be merged, and analogue circuits can also be provided to perform equivalent functions as the above described components.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A restaurant service indicator system, said system consisting of:

a table unit consisting of a first processor that is in electrical communication with a first memory, a transmitter that functions to transmit a plurality of wireless signals, a table unit power source, a plurality of input devices, said input devices consisting of a first push button indicating a come-now service request, and a second push button indicating a do-not-disturb service request, a first request sent indicator consisting of a green light that is configured to activate when the first push button is engaged, and a second request sent indicator consisting of a red light that is configured to activate when the second push button is engaged; and a server unit that consists of a second processor that is in electrical communication with a second memory, a receiver that functions to receive one or more of the plurality of wireless signals from the transmitter, a plurality of table status indicators, said indicators including a first green light that is configured to activate when the first push button is engaged, and a first red light that is configured to activate when the second push button is engaged, a server unit power source, an audio jack disposed within the server unit, and a mechanical vibration unit that is also disposed within the server unit, each of said audio jack and vibration unit being configured to activate when one of the first or second push buttons of the table unit are engaged, wherein the transmitter and receiver are configured for direct communication, and each of the plurality of service requests are sent by the transmitter directly to the receiver.

2. The system of claim 1, wherein the plurality of table status indicators further includes another green light configured to activate when the a first push button of another table unit is engaged, and another red light configured to activate when a second push button of another table unit is engaged.

3. The system of claim 2, wherein each of the table status indicators further includes an identification tag for identifying the particular table unit which transmitted the request.

4. The system of claim 1, wherein each of the service requests are transmitted as at least one of a radio signal, an infrared signal, a Bluetooth signal, a microwave signal, and an RFID signal.

5. The system of claim 1, wherein said transmitter consists of:

a variable radio wave transmitter that functions to transmit a plurality of unique radio frequencies; and said receiver consists of:

a variable radio wave receiver that functions to receive one or more of the plurality of unique radio frequencies from the variable radio wave transmitter.

6. A restaurant service indicator system kit, consisting of:

a plurality of table units, each of said units consisting of a first processor that is in electrical communication with a first memory, a transmitter that functions to transmit a plurality of wireless signals, a table unit power source, a plurality of input devices, said input devices consisting of a first push button indicating a come-now service request, and a second push button indicating a do-not-disturb service request, a first request sent indicator consisting of a green light that is configured to activate when the first push button is engaged, and a second request sent indicator consisting of a red light that is configured to activate when the second push button is engaged; and a server unit consisting of a second processor that is in electrical communication with a second memory, a receiver that functions to receive one or more of the plurality of wireless signals from each table unit transmitter, a plurality of table status indicators corresponding to each of the table units, said indicators including a first green light that is configured to activate when the first push button of a particular table unit is engaged, and a first red light that is configured to activate when the second push button of a particular table unit is engaged, a server unit power source, an audio jack disposed within the server unit, and a mechanical vibration unit that is also disposed within the server unit, each of said audio jack and vibration unit being configured to activate when any one of the push buttons of any one of the table units are engaged, wherein the transmitter of each of the plurality of table units is configured to transmit the service request signal to the receiver of the service unit, and each of said signals further include identification information corresponding to the transmitting table unit;

a charging station configured to interface with the server unit power source; and a user instruction manual.

7. The kit of claim 6, wherein the plurality of table units consists of:

six individual units.

8. The system of claim 6, wherein each of the service requests are transmitted as at least one of a radio signal, an infrared signal, a Bluetooth signal, a microwave signal, and an RFID signal.

9. The system of claim 6, wherein each of said transmitters consists of:

a variable radio wave transmitter that functions to transmit a plurality of unique radio frequencies; and said receiver consists of:

a variable radio wave receiver that functions to receive one or more of the plurality of unique radio frequencies from each of the variable radio wave transmitters.

* * * * *